US011215038B2

(12) United States Patent
Cotton

(10) Patent No.: US 11,215,038 B2
(45) Date of Patent: Jan. 4, 2022

(54) ROTATING HANGER RUNNING TOOL

(71) Applicant: Patriot Research Center, LLC, Houston, TX (US)

(72) Inventor: Craig Cotton, Cypress, TX (US)

(73) Assignee: Patriot Research Center, LLC, Houston, TX (US)

( * ) Notice: Subject to any disclaimer, the term of this patent is extended or adjusted under 35 U.S.C. 154(b) by 0 days.

(21) Appl. No.: 16/878,300

(22) Filed: May 19, 2020

(65) Prior Publication Data

US 2021/0363861 A1 Nov. 25, 2021

(51) Int. Cl.
*E21B 43/10* (2006.01)
*E21B 17/06* (2006.01)

(52) U.S. Cl.
CPC ..... *E21B 43/10* (2013.01); *E21B 17/06* (2013.01)

(58) Field of Classification Search
CPC ..... E21B 43/10; E21B 17/06
See application file for complete search history.

(56) References Cited

U.S. PATENT DOCUMENTS

| | | | | |
|---|---|---|---|---|
| 2,337,733 | A * | 12/1943 | Burns | E21B 43/10 166/124 |
| 8,528,650 | B1 * | 9/2013 | Smith | E21B 19/06 166/382 |
| 9,689,229 | B2 * | 6/2017 | Hanson | E21B 33/0415 |
| 2015/0041151 | A1 * | 2/2015 | Cocker, III | E21B 33/0415 166/380 |
| 2015/0152701 | A1 * | 6/2015 | Levert, Jr. | E21B 33/04 166/380 |
| 2015/0345242 | A1 * | 12/2015 | Fernandes | E21B 33/04 166/208 |
| 2017/0167218 | A1 * | 6/2017 | Cheah | E21B 23/02 |

* cited by examiner

*Primary Examiner* — Taras P Bemko
(74) *Attorney, Agent, or Firm* — The Kubiak Law Firm PLLC

(57) ABSTRACT

A rotating hanger running tool is provided allowing torque to be transmitted to a sleeve and then the casing by a set of directionally and rotationally biased dogs while bypassing a right-hand thread engaging the running tool to the casing. Upon rotating the tool in the opposite direction torque is transmitted to the right-hand thread causing the running tool and the casing to disengage.

6 Claims, 8 Drawing Sheets

ROTATING HANGER RUNNING TOOL

BACKGROUND

When drilling and oil and gas well after drilling the well the well must be cased. However, a typical shale play well tend to substantially deviate from vertical. While one of these wells may be 10,000 feet deep it could be 20,000 to 30,000 feet in total length. The casing may be relatively easy to insert into the well when the well is essentially vertical however many of these wells have substantial horizontal sections where simple gravity will not move the casing into the well. In such wells many techniques may be used to move the casing into the well, such as pushing the casing into the well, however virtually all of them rely on keeping the casing in motion. The most reliable motion has been found to be circular. In other words, the casing must be rotated about its long axis the entire time that it is being inserted into the well.

Casing hangers are used in oil and gas drilling to suspend casing strings within the wellhead and facilitate the use of an annulus seal between the casing string and the wellhead bore and generally are not conducive to rotating the casing. Generally, in the past casing hangers have been modified by notching the hanger to provide a torque transfer mechanism between the running tool and the casing hanger in order to allow provide a rotating feature.

For instance, wells are often lined with casing which generally serves to stabilize and isolate the wellbore from certain formations penetrated by the well. Such casing is frequently cemented into the well during the cement job. During the cement job cement is usually pumped through the interior of the casing or tubular, out the lower end of the tubular and then with no place else to go the cement then continues back up towards the surface but in the annular area between the wellbore and the casing, ultimately surrounding the casing. Once the cement sets the casing is locked in place and the cement acts as a seal to fluid barrier to fluid exterior of the casing.

SUMMARY

In an embodiment of the current invention the running tool includes a sleeve and at least one radially outward and rotationally biased dog. The sleeve is generally free to rotate clockwise or counterclockwise about the centerline of the tool as long as the radially outward and rotationally biased dogs are not engaged with the sleeve. The sleeve includes at least one directional slot to engage with the at least one radially outward and rotationally biased dog. Initially the at least one radially outward and rotationally biased dog is held in the retracted position such that it cannot engage the at least one directional slot in the sleeve. With the at least one radially outward and rotationally biased dog in its retracted position the running tool may be turned clockwise as seen from the surface looking down to engage the right-hand thread in the upper end of the casing. The at least one radially outward and rotationally biased dog has an angled surface formed on the radially outward end. Likewise, the directional slot formed in the sleeve is formed to include an angled surface. The dog's angled surface and the slot's angled surface interact such that in the event the running tool is rotated in a counterclockwise direction the two angled surfaces will create a radially inward force on the outwardly biased dog to move the outwardly biased dog into a temporarily retracted position which in turn allows the running tool to rotate in a counterclockwise direction without also turning the sleeve.

The at least one radially outward and rotationally biased dog has, opposite the angled surface formed on the radially outward end, a surface formed to engage a surface of the directional slot. The dog's engaging surface and the directional slot's engaging surface interact such that in the event the running tool is rotated in a clockwise direction the two engaging surfaces transfer torque from the running tool to the sleeve. Which in turn allows the running tool and sleeve to both rotate in a clockwise direction without also transferring torque though the right hand thread in the upper end of the casing.

Once released the at least one radially outward and rotationally biased dog may engage the sleeve when the running tool is turned clockwise about its long axis as seen from the surface looking down. The sleeve has at least one castellation that engages a matching castellation in the liner hanger such that when the castellation of the sleeve engages the castellation of the liner hanger when the sleeve rotates the liner hanger and its attached casing rotate. Once the casing has been run to depth or whenever the operator desires the casing and liner hanger may be released for the running tool by simply rotating the running tool in a counterclockwise direction. Rotating the running tool in a counterclockwise direction allows the directionally biased dogs to temporarily move inward from the slots so that torque is no longer transferred to the sleeve but allows the right-hand thread and the running tool to unthread from one another. Once all of the threads are released the running tool and sleeve are free to be retrieved or otherwise raised from the casing and liner hanger.

DETAILED DESCRIPTION

The description that follows includes exemplary apparatus, methods, techniques, or instruction sequences that embody techniques of the inventive subject matter. However, it is understood that the described embodiments may be practiced without these specific details.

Figure 1:
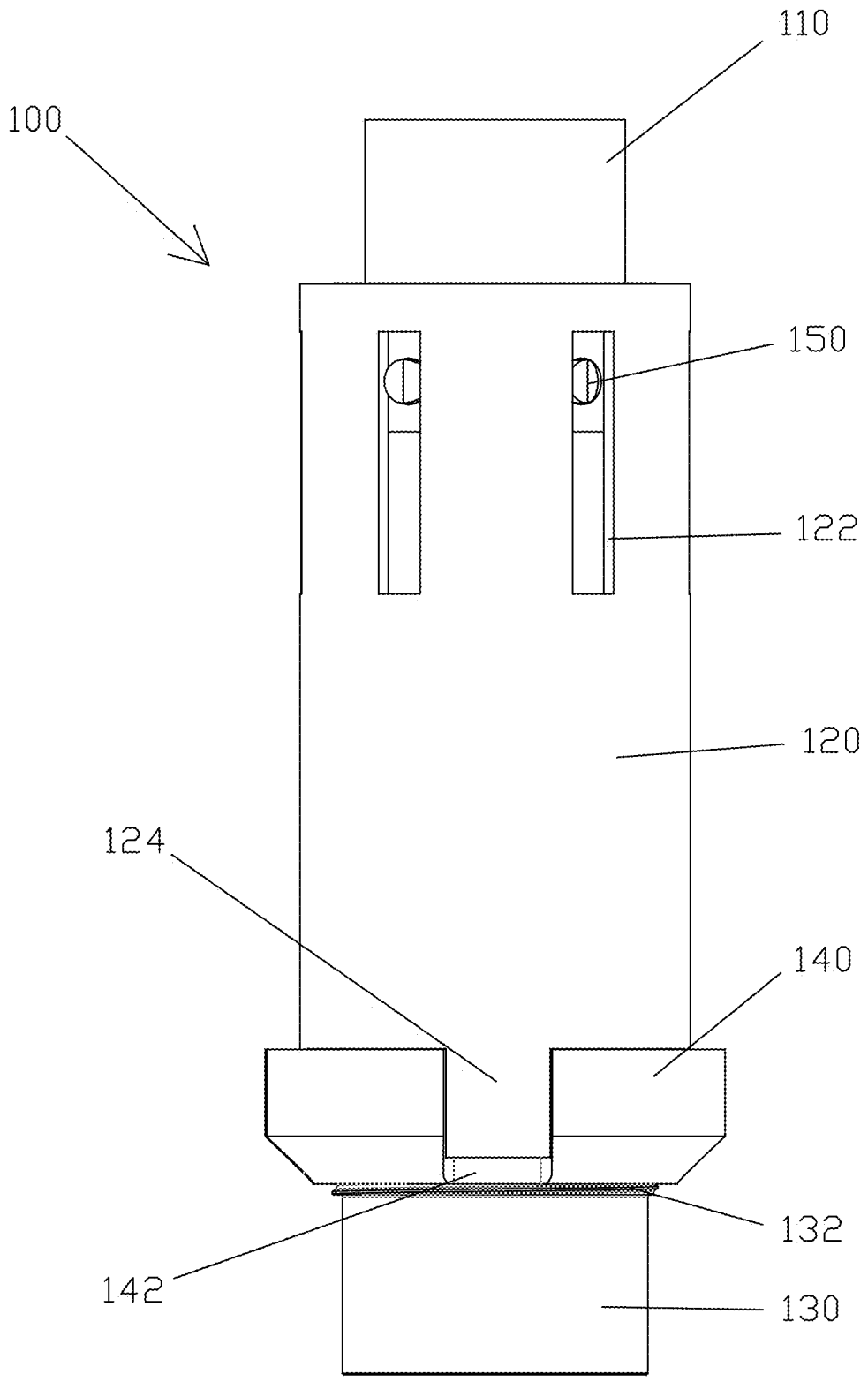
FIG. 1 depicts a side view of a rotating hanger running tool.

FIG. 1 depicts a side view of a rotating hanger running tool 100. The rotating hanger running tool 100 includes a running tool 110, a sleeve 120, a casing 130, a liner hanger 140, and at least one radially outward and directionally biased dog 150. The casing 130 includes a threaded portion 132. The liner hanger 140 includes at least one slot 142. The sleeve 120 includes at least one castellation 124. Depending upon the rotational alignment between the liner hanger 140 and the sleeve 120 the sleeve castellation 124 may be located within the slot 142 with liner hanger 140. The sleeve 120 includes at least one slot 122. The at least one radially outward direction biased dogs 150 are located within the running tool 110 and depending upon the rotational alignment between the running tool 110 and the sleeve 120 may be partially located within the slot or slots 122 within sleeve 120.

Figure 2:
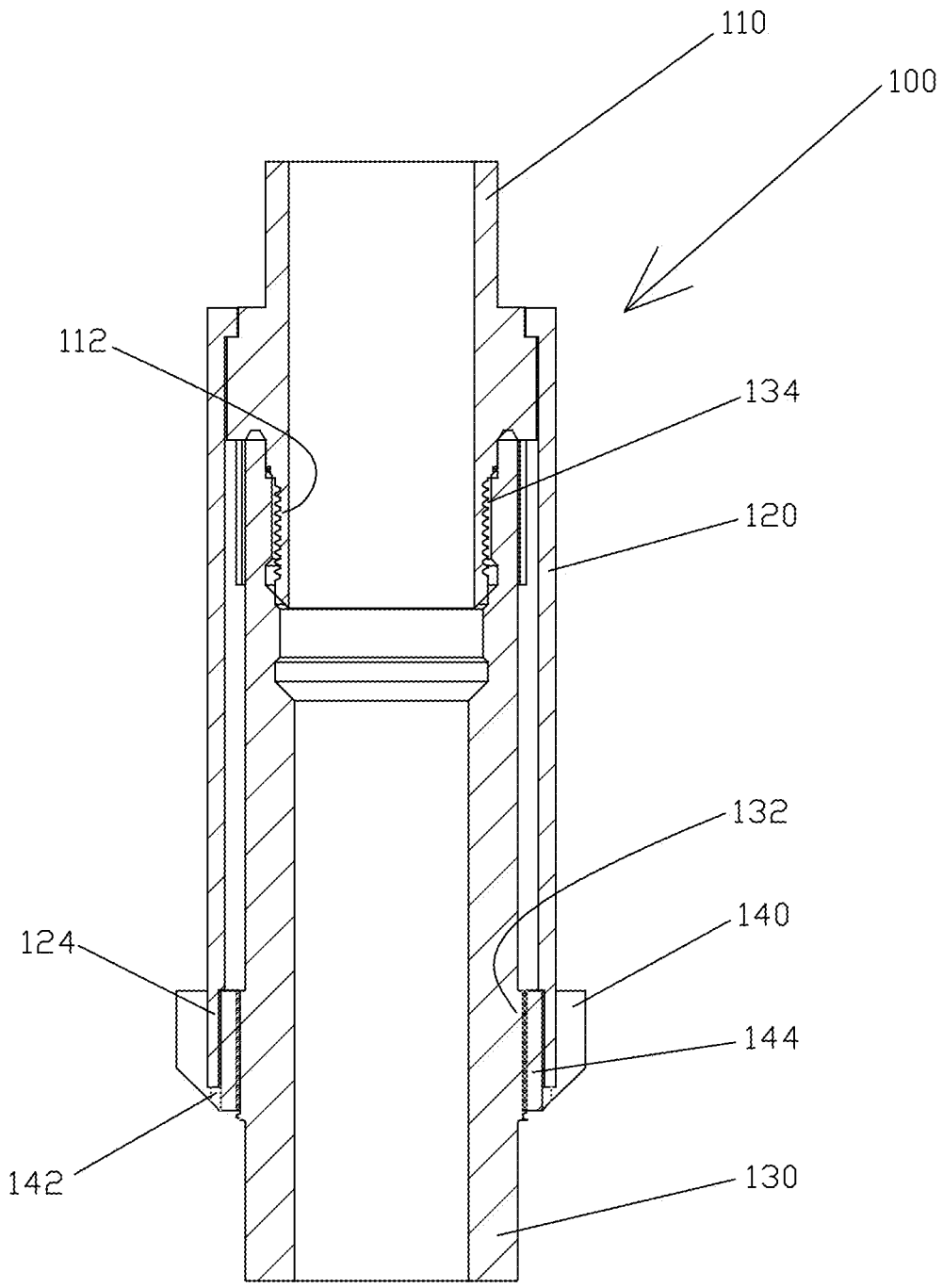
FIG. 2 depicts a cutaway view of a rotating hanger running tool.

FIG. 2 depicts a cutaway view of a rotating hanger running tool 100 from FIG. 1. As before the rotating hanger running tool 100 includes the running tool 110, the sleeve 120, the casing 130, and the liner hanger 140. The casing 130 includes a threaded portion 132. The liner hanger 140 includes a threaded portion 144 that matches and threads onto the casing threaded portion 132. The casing 130 includes a casing second threaded portion 134. The running tool 110 includes a threaded portion 112 that matches and threads onto the casing second threaded portion 134. The casing second threaded portion 134 and the running tool threaded portion 112 are typically right hand threads and when the running tool threaded portion 112 and the casing second threaded portion 134 are threaded together, generally in a low or no torque condition, the running tool 110 may support the casing 130. By utilizing low or no torque when the running tool threaded portion 112 and the casing second threaded portion 134 are threaded together the running tool 110 may be easily disconnected from the casing 130.

Figure 3:
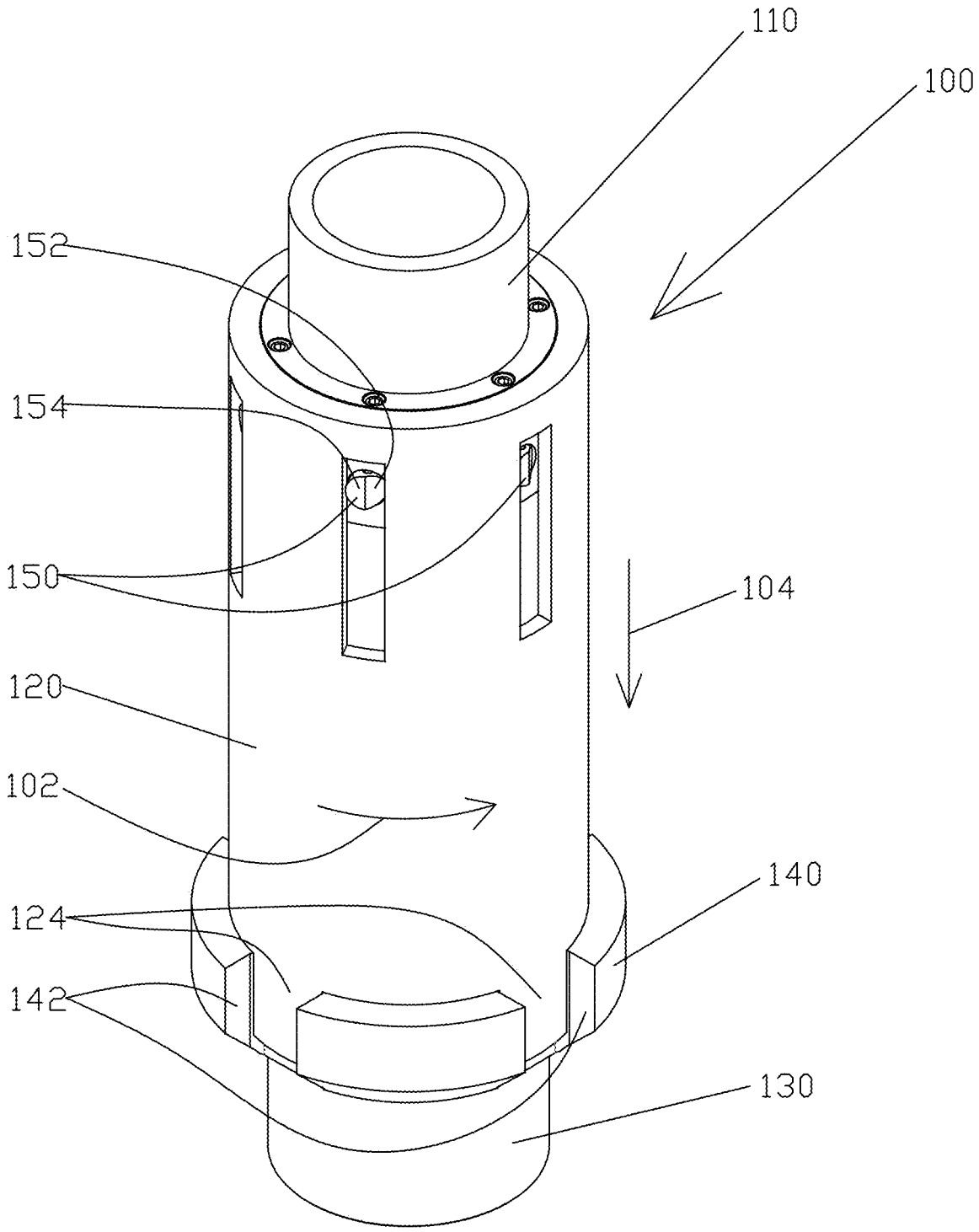
FIG. 3 depicts an orthogonal view of a rotating hanger running tool.

FIG. 3 depicts an orthogonal view of the rotating hanger running tool 100 from FIG. 1. As before the rotating hanger running tool 100 includes the running tool 110, the sleeve 120, the casing 130, the liner hanger 140, and at least one radially outward and directionally biased dog 150. In FIG. 3 two radially outward and directionally biased dogs 150 may be seen. An angled surface 152 can be observed on a radially outward face 154 of the radially outward and directionally biased dogs 150. Generally, the angled surface 152 is on the radially outward and forward surface of the radially outward and directionally biased dog 150. Where forward is the leading edge of the radially outward and directionally biased dog 150 when the running tool 110 is rotated in counterclockwise direction as seen from the surface looking down upon the running tool 110. Arrow 102 points in the counterclockwise direction while arrow 104 points downwards. As will be further described below, the angled surface 152 contributes to the directional bias of the radially outwards and directionally biased dogs 150. The liner hanger 140 includes at least one slot 142. In FIG. 3 two slots 142 may be seen. The sleeve 120 includes at least one slot 122. In FIG. 3 two slots 122 may be seen. The sleeve 120 includes at least one castellation 124. In FIG. 3 two castellations 124 may be seen. Depending upon the rotational alignment between the liner hanger 140 and the sleeve 120 the sleeve castellations 124 may be located within the slots 142 within liner hanger 140. The radially outward and directionally biased dogs 150 are located within the running tool 110 and depending upon the rotational alignment between the running tool 110 and the sleeve 120 may be partially located within the slots 122 within sleeve 120.

Figure 4:
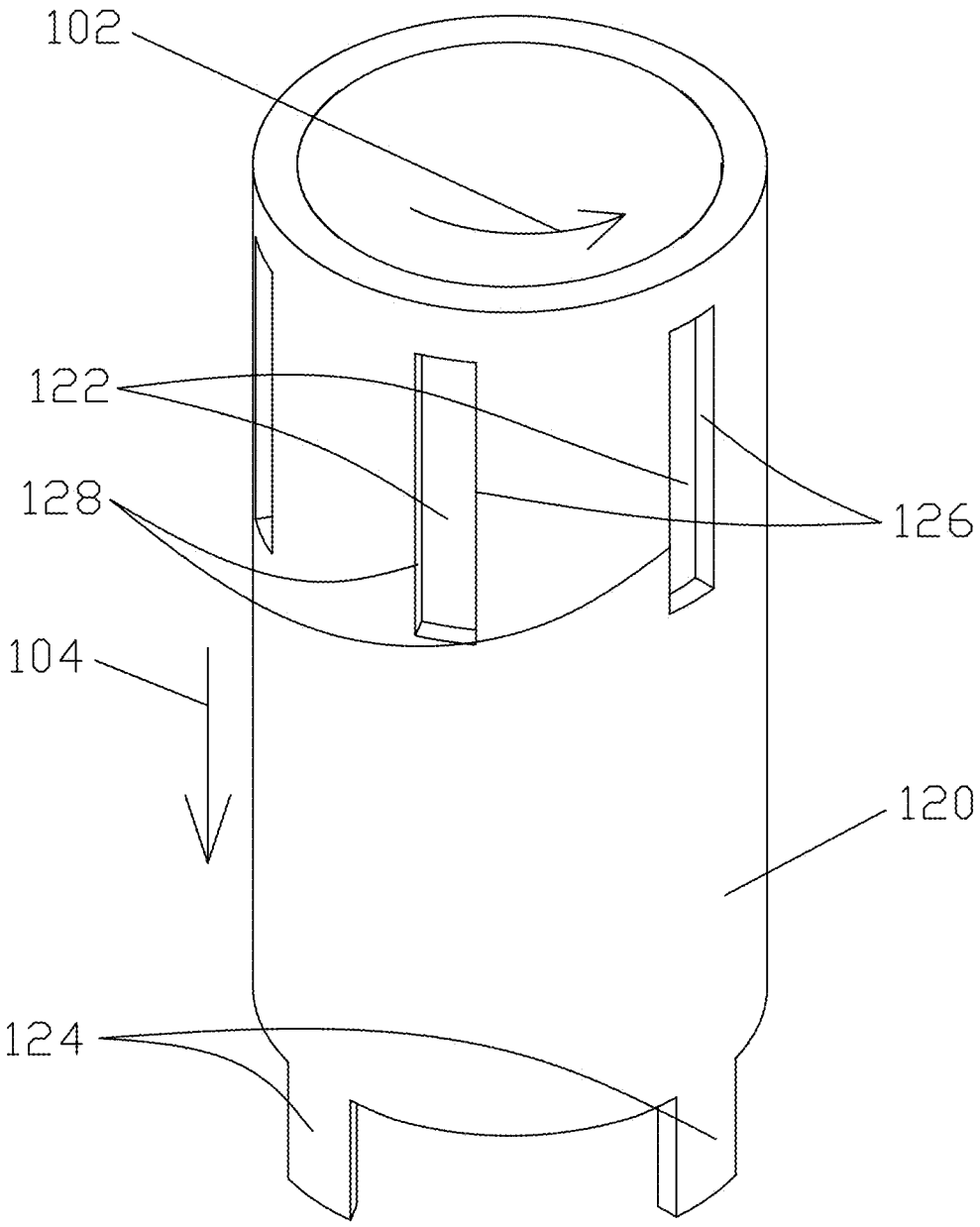
FIG. 4 depicts a side view of a rotating running tool sleeve.

FIG. 4 depicts a side view of a rotating running tool sleeve. FIG. 4 is the sleeve 120 from FIGS. 1-3. Arrow 102 points in the counterclockwise direction while arrow 104 points downwards. The sleeve 120 includes at least one slot 122. In FIG. 4 at least two slots 122 may be seen. The sleeve 120 includes at least one castellation 124. In FIG. 4 two castellations 124 may be seen. Slots 122 have a leading edge and a trailing edge 128. Generally, the leading edges 126 will include an angle to match the angle 152 on the forward surface of the radially outward and directionally biased dogs 150 while the trailing edges 128 will include surface to engage the rearward surface of the radially outward and directionally biased dogs 150.

Figure 5:
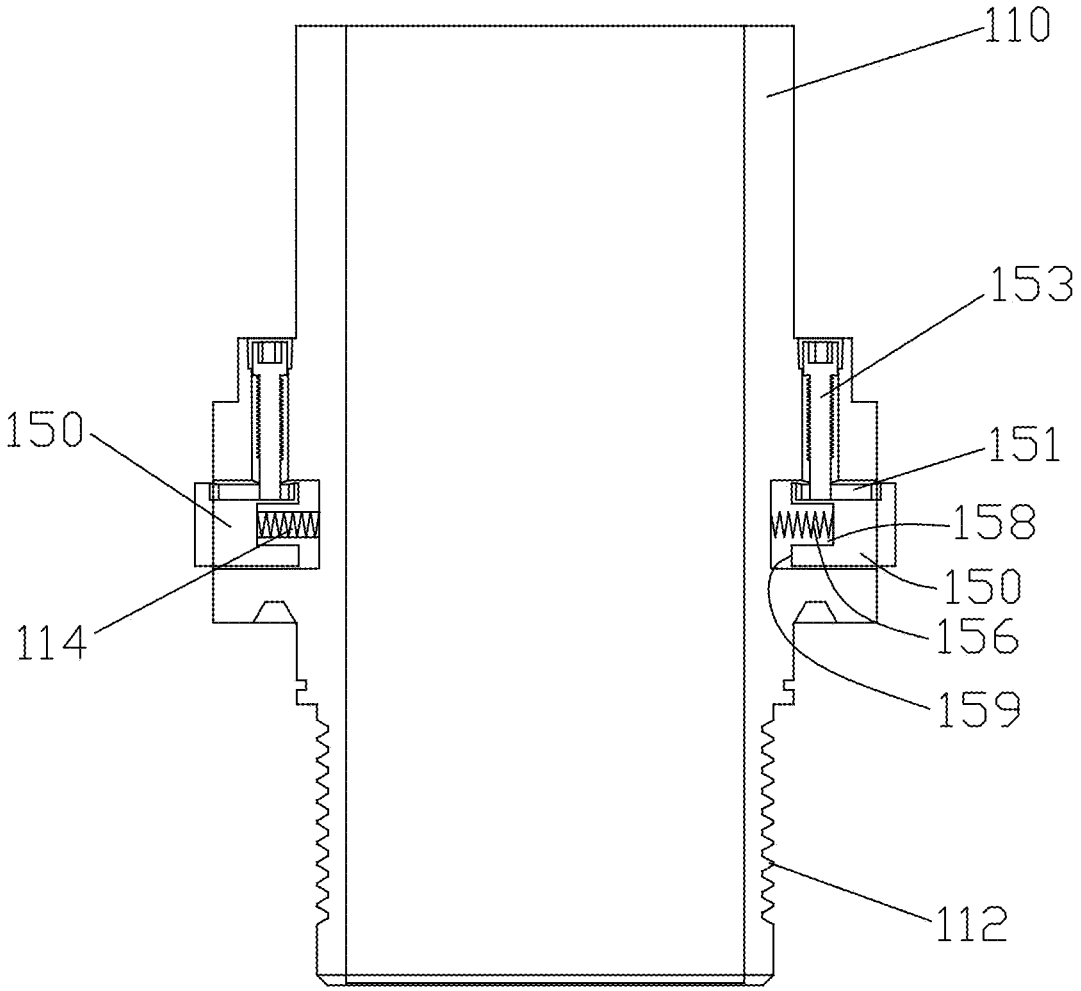
FIG. 5 depicts a side cutaway view of a rotating running tool without a sleeve.

FIG. 5 depicts a side cutaway view of a running tool 110. The rotating running tool 110 includes a right hand thread 112 at the lower end of the rotating running tool 110. The right hand thread 112 generally threads to the casing 130 and allows the running tool 110 to support the casing 130 while the casing 130 is being run into a well. The rotating running tool 110 has at least one recess 114 for a radially outward and directionally biased dog 150. In this instance a spring 156 is placed against a radially inward surface 159 of the dog 150 although any bias device such as a gas bellows or an elastomer may be used to provide a radially outward bias force may be used. In a preferred embodiment an end of the spring 156 is placed within a recess 158 on the radially inward surface 159 of the dog 150 to provide the radially outward bias of the dog 150. The dog 150 includes a slot 151 on an upper side of the dog 150. A pin 153 is placed partially within the slot 151. The pin 153, in this case a screw, retains the dog 150 within the recess 114 while allowing the dog 150 to travel radially outward and radially inwards within recess 114.

Figure 6B:
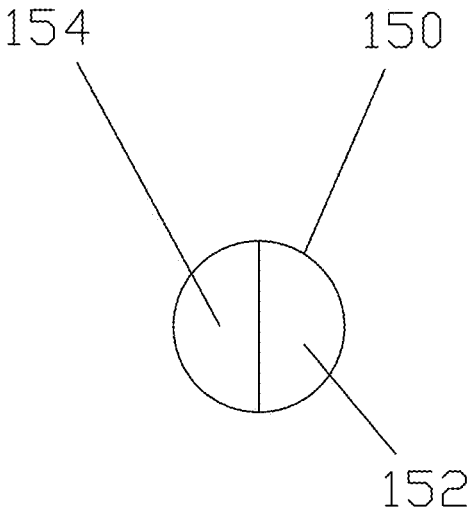
FIG. 6B depicts an end view of a dog.
Figure 6A:
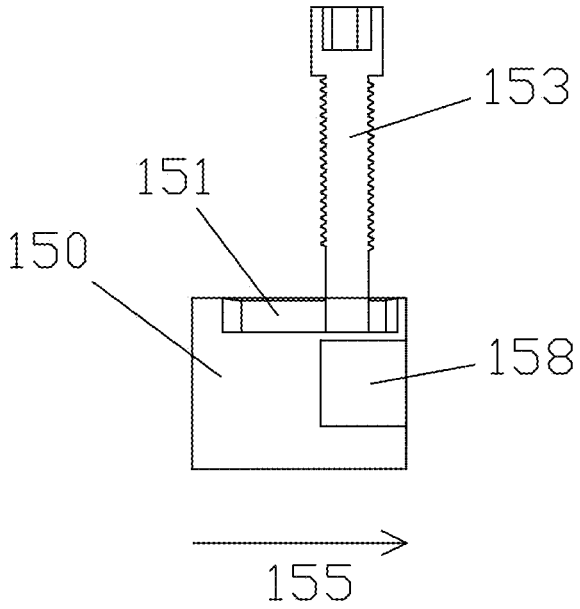
FIG. 6A depicts a side cutaway view of a dog.

FIGS. 6 A-C depict various views of the dog 150. FIG. 6A depicts a side cutaway view of a dog. Arrow 155 points to the radially inward direction with the recess 158 radially inward on the dog 150. Generally, one end of the bias device such as the spring is placed within the recess 158. A slot 151 is on the upper surface of the dog 150 to allow an end of the pin 153 to be placed partially within the slot 151 so that dog 150 is retained within the recess 114 on the running tool 110 (not shown).

FIG. 6B is an end view of the radially outward end of the dog 150. The radially outward face 154 end of the dog 150 includes the angled surface 152.

Figure 6C:
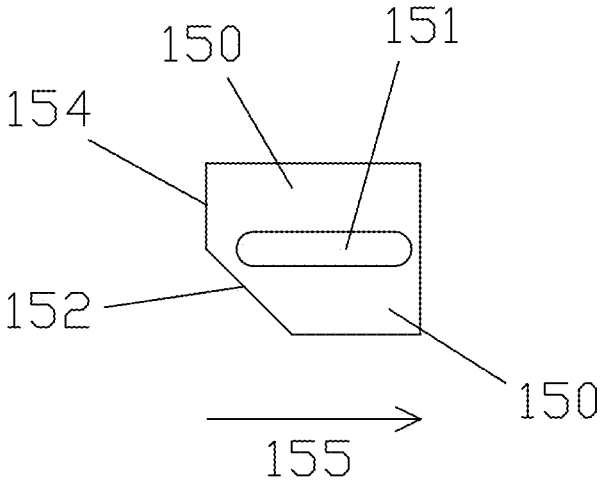
FIG. 6C depicts a top view of a dog.

FIG. 6C is a top view of a dog. Arrow 155 indicates the radially inward direction. As can be readily seen the dog 150 has the radially outward face 154 and the angled surface 152. In a preferred embodiment the angled surface 152 is set at a 45-degree angle to the radially outward surface 154. The slot 151 is formed into the upper surface of the dog 150.

Figure 7:
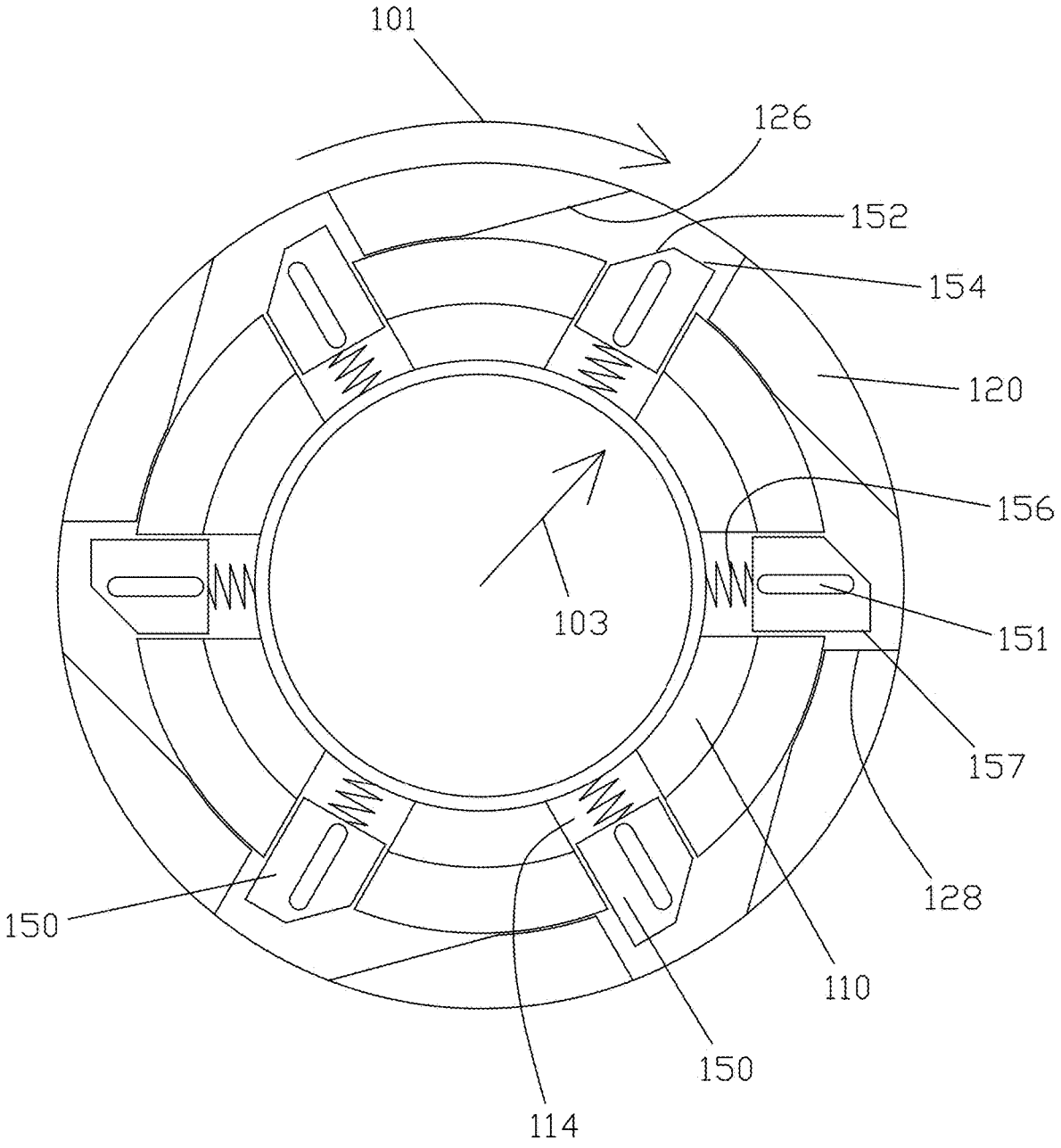
FIG. 7 depicts a top down view of a running tool and sleeve with the dogs extended radially outwards while rotating in a clockwise direction.

FIG. 7 depicts a top down cutaway view of a running tool 110 and sleeve 120 with the dogs 150 extended radially outwards rotating in a clockwise direction. Arrow 101 depicts the clockwise direction when looking down towards the tool from the surface. Arrow 103 depicts the radially outward direction. As the running tool 110 is rotated in a clockwise direction each of the dogs 150 are biased radially outwards by the bias device such as by spring 156. Initially, the running tool 110 may turn in the clockwise direction while the sleeve 120 remains stationary. As the radially outward surface 154 of the dog 150 reaches the leading edge 126 of slot 122 the dog 150 is able to move radially outwards within recess 114 of the running tool 110. However, as the dog 150 continues to move in a clockwise direction and fully aligns with the slot 122, the dog 150 is prevented from being ejected from the running tool 110 through slot 122 by pin 153 (see FIG. 5) that resides partially within slot 151 in the upper surface of the dog 150. With the dog 150 now extended to the limit of its travels within slot 114 as the dog 150 and running tool 110 continue to turn in the clockwise direction the leading edge 157 of dog 150 will contact trailing edge 128 of slot 122. As the running tool 110 continues to turn in the clockwise direction along with the dog 150 the now engaged dog 150 and slot 122 will cause the sleeve 120 to also turn in the clockwise direction. Provided that the castellations 124 are within liner hanger slots 142 (see FIG. 3) the clockwise torque is transferred from the running tool 110 through the dogs 150 to the sleeve 120. From the sleeve 120 the torque is transferred through the castellations 124 to the liner hanger 140 and finally from the liner hanger 140 to the casing 130. The torque transmission thereby bypasses the right-hand threads 112 and 134. Torque through the right-hand threads 112 and 134 could cause overtightening of the joint preventing the running tool 110 from later disconnecting from the casing 130.

Figure 8:
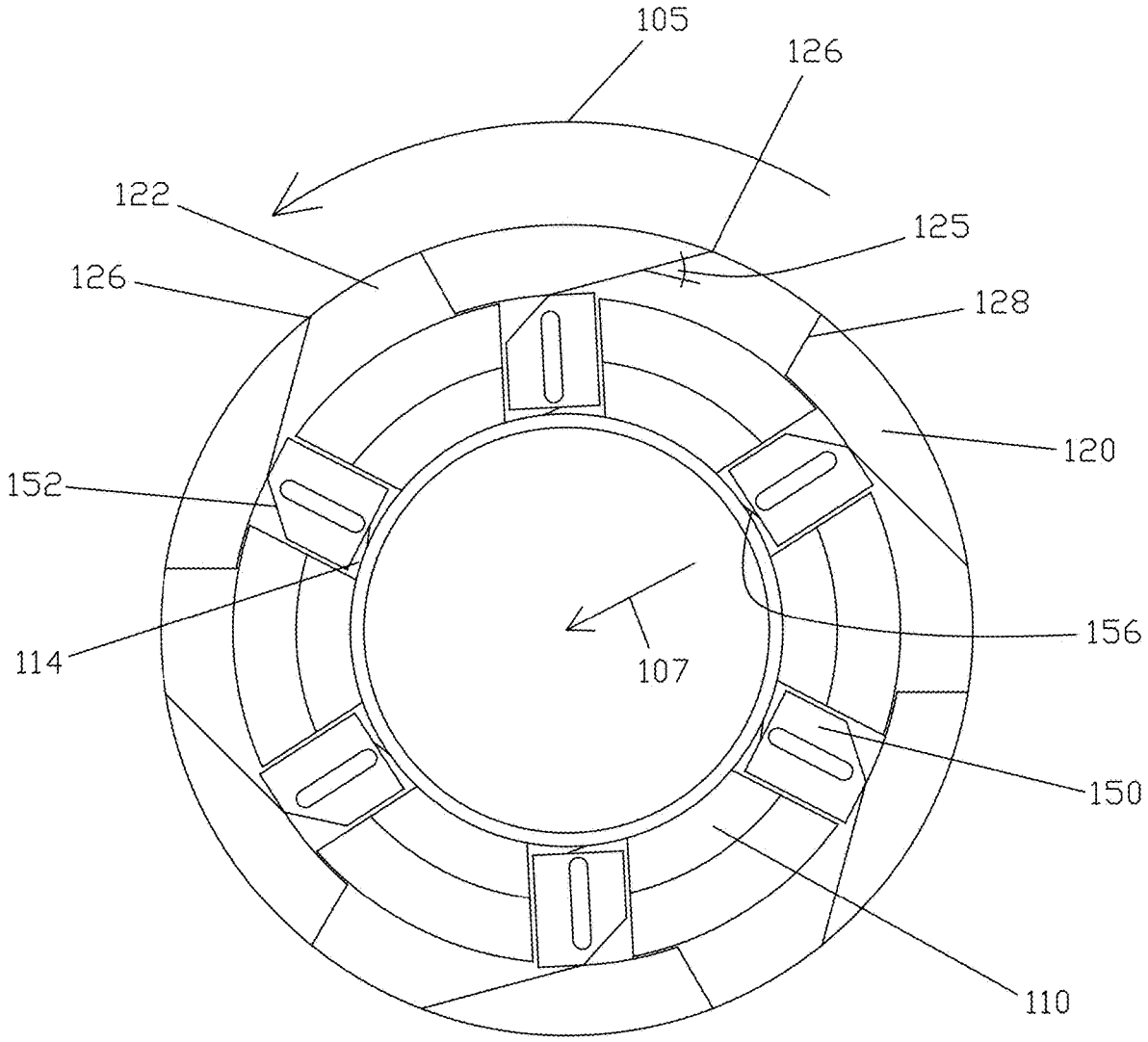
FIG. 8 depicts a top down view of a running tool and sleeve with the dogs extended radially outwards while rotating in a counterclockwise direction.

FIG. 8 depicts a top down cutaway view of a running tool 110 and sleeve 120 with the dogs 150 retracted radially inwards while rotating in a counterclockwise direction. Arrow 105 depicts the counterclockwise direction when looking down towards the tool from the surface. Arrow 107 depicts the radially inward direction. Upon the running tool 110 turning in the counterclockwise direction while the sleeve 120 remains relatively stationary with regard to the running tool 110. As the angled surface 152 of the dog 150 reaches the leading edge 126 of slot 122 the dog 150 is forced radially inward into recess 114 by the interaction between the angled surface 152 of the dog 150 and the cooperating angle 125 of the leading edge 126. With the dog 150 now retracted within slot 114 as the dog 150 and running tool 110 continue to turn in the counterclockwise the dogs 150 and the running tool 110 are disengaged from the sleeve 120. Torque is no longer transmitted from the running tool 11 through the dogs 150 to the sleeve 120. The counterclockwise torque is now transmitted from the running tool 110 to the right-hand threads 112. However, as the threads 112 and 134 were not previously overtightened the connection between the running tool 110 and the casing 130 through the right-hand threads 112 and 134 is now disengaged and the running tool 110 and sleeve 120 may be retrieved while the liner hanger 140 and the casing 130 remain.

The nomenclature of leading, trailing, forward, rear, clockwise, counterclockwise, right hand, left hand, upwards, and downwards are meant only to help describe aspects of the tool that interact with other portions of the tool.

Plural instances may be provided for components, operations or structures described herein as a single instance. In general, structures and functionality presented as separate components in the exemplary configurations may be implemented as a combined structure or component. Similarly, structures and functionality presented as a single component may be implemented as separate components. These and other variations, modifications, additions, and improvements may fall within the scope of the inventive subject matter.

What is claimed is:

1. A rotating hanger running tool system comprising;

a rotating running tool having a right-hand thread and at least one dog, wherein the dog includes an angled surface, further wherein as the dog rotates in a counterclockwise direction, as viewed from above, the dog passes a slot in an outer sleeve allowing the dog to move radially outwards from an outer surface of the running tool into the slot, as the dog continues to rotate in the counterclockwise direction the dog's angled surface and an edge of the slot cooperate to move the dog radially inwards, a sleeve having at least one castellation on an end and at least one slot, a liner hanger having at least one recess and coupled to a casing, the casing has a right-hand thread, wherein the casing right hand thread and the rotating running tool right hand thread are coupled such that the rotating running tool supports the casing.

2. The rotating running tool system of claim 1 wherein, the at least one slot in the outer sleeve includes an edge having an angled surface to interact with the at least one dog to move the dog radially inwards.

3. The rotating running tool system of claim 1 wherein, the at least one dog interacts with the sleeve to drive the sleeve in a clockwise direction when the rotating running tool is rotated in a clockwise direction.

4. The rotating running tool system of claim 1 wherein, the at least one dog interacts with the sleeve such that the sleeve is not rotated when the rotating running tool is rotated in a counterclockwise direction.

5. The rotating running tool system of claim 1 wherein, the at least one liner hanger recess and the at least one sleeve castellation cooperate to apply a torque from the sleeve to the liner hanger.

6. The rotating running tool system of claim 1 wherein, rotating the running tool in a clockwise direction such that the liner hanger right hand thread and the casing right-hand thread become uncoupled.

* * * * *